US011384601B2

(12) United States Patent
Graham et al.

(10) Patent No.: US 11,384,601 B2
(45) Date of Patent: Jul. 12, 2022

(54) HOLE OPENER FOR HORIZONTAL DIRECTIONAL DRILLING

(71) Applicant: Precise Drilling Components Ltd, Calgary (CA)

(72) Inventors: Cody D. Graham, Calgary (CA); Jeffrey S. Mueller, Brownsville, WI (US)

(73) Assignee: Precise Drilling Components Ltd, Calgary (CA)

( * ) Notice: Subject to any disclaimer, the term of this patent is extended or adjusted under 35 U.S.C. 154(b) by 90 days.

(21) Appl. No.: 16/804,443

(22) Filed: Feb. 28, 2020

(65) Prior Publication Data

US 2020/0277822 A1 Sep. 3, 2020

Related U.S. Application Data

(60) Provisional application No. 62/812,316, filed on Mar. 1, 2019.

(51) Int. Cl.
*E21B 7/04* (2006.01)
*E21B 10/43* (2006.01)

(52) U.S. Cl.
CPC ..... *E21B 7/046* (2013.01); *E21B 10/43* (2013.01)

(58) Field of Classification Search
CPC . E21B 7/046; E21B 7/28; E21B 10/26; E21B 10/43; E21B 10/633
See application file for complete search history.

(56) References Cited

U.S. PATENT DOCUMENTS

| | | | | |
|---|---|---|---|---|
| 2,990,896 A * | 7/1961 | Kandle | ..... | E21B 10/44 175/171 |
| 3,830,321 A | 8/1974 | McKenry et al. | | |
| 4,604,106 A | 8/1986 | Hall | | |
| 4,942,933 A | 7/1990 | Barr et al. | | |
| 5,337,843 A | 8/1994 | Torgrimsen et al. | | |

(Continued)

FOREIGN PATENT DOCUMENTS

| | | | | |
|---|---|---|---|---|
| CN | 205477371 U | 8/2016 | | |
| DE | 3112172 A1 | 10/1982 | | |
| WO | WO-0058595 A1 * | 10/2000 | ..... | E21B 10/30 |

OTHER PUBLICATIONS

Office Action from the Canada Patent Office for related Application No. 3074236 dated Apr. 29, 2021 (6 Pages).

*Primary Examiner* — Giovanna Wright
*Assistant Examiner* — Ronald R Runyan
(74) *Attorney, Agent, or Firm* — Michael Best & Friedrich LLP

(57) ABSTRACT

A hole opener comprising a shaft, a key, a first blade, and a second blade. The shaft includes a front end, a rear end, and a longitudinal axis that extends through the front end and the rear end, the shaft configured for rotation about the longitudinal axis by the horizontal directional drilling rig. The key is coupled to the shaft for rotation with the shaft. The first blade is removably coupled to the key, and is spaced a first radial distance from the longitudinal axis and spaced a first longitudinal distance from the front end. The second blade is removably coupled to the key and is spaced a second radial distance from the longitudinal axis that is greater than the first radial distance. The second blade is spaced a second longitudinal distance from the front end that is greater than the first longitudinal distance.

17 Claims, 18 Drawing Sheets

(56) References Cited

U.S. PATENT DOCUMENTS

| | | | | |
|---|---|---|---|---|
| 6,328,117 | B1 | 12/2001 | Berzas et al. | |
| 8,505,634 | B2 | 8/2013 | Lyons et al. | |
| 9,951,563 | B2 | 4/2018 | Beaton et al. | |
| 10,107,041 | B2 | 10/2018 | Herman et al. | |
| 2008/0029312 | A1 | 2/2008 | Hall et al. | |
| 2010/0175927 | A1* | 7/2010 | Zulak | E21B 10/633 175/413 |
| 2011/0067930 | A1 | 3/2011 | Beaton | |
| 2011/0127089 | A1 | 6/2011 | Beaton | |
| 2015/0060149 | A1 | 3/2015 | Herman et al. | |
| 2015/0218935 | A1* | 8/2015 | Pelletier | E21B 12/02 175/327 |
| 2016/0017665 | A1 | 1/2016 | Beaton | |
| 2016/0084010 | A1 | 3/2016 | Beaton et al. | |
| 2016/0312538 | A1 | 10/2016 | Marley et al. | |
| 2018/0283105 | A1* | 10/2018 | Thomas | E21B 7/30 |
| 2019/0040687 | A1 | 2/2019 | Herman et al. | |

* cited by examiner

HOLE OPENER FOR HORIZONTAL DIRECTIONAL DRILLING

CROSS-REFERENCE TO RELATED APPLICATIONS

This application claims priority to U.S. Provisional Patent Application No. 62/812,316, filed Mar. 1, 2019, the entire contents of which are hereby incorporated by reference.

BACKGROUND

The present invention relates to a hole opener particularly suited for use with a horizontal directional drilling rig.

SUMMARY

In one aspect, the invention provides a hole opener for use with a horizontal directional drilling rig, the hole opener comprising a shaft, a key, a first blade, and a second blade. The shaft includes a front end, a rear end, and a longitudinal axis that extends through the front end and the rear end, the shaft configured for rotation about the longitudinal axis by the horizontal directional drilling rig. The key is coupled to the shaft for rotation with the shaft. The first blade is removably coupled to the key, and is spaced a first radial distance from the longitudinal axis and spaced a first longitudinal distance from the front end. The second blade is removably coupled to the key and is spaced a second radial distance from the longitudinal axis that is greater than the first radial distance. The second blade is spaced a second longitudinal distance from the front end that is greater than the first longitudinal distance.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
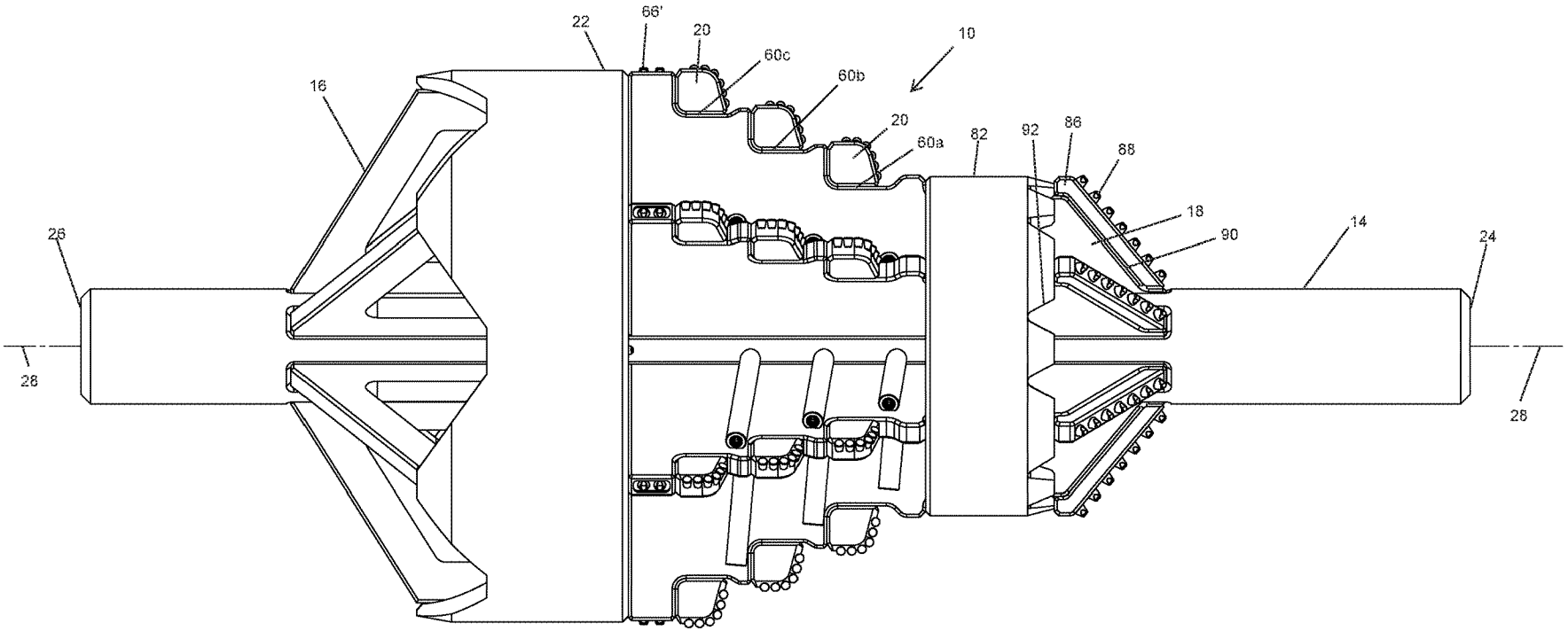
FIG. 1 is a side view of a hole opener according to one embodiment of the invention.

FIG. 1 illustrates a hole opener or reamer 10. The hole opener 10 is particularly suited for use with a horizontal directional drilling rig 12 (FIG. 17) for creating underground bores. The underground bores are used for utilities, including water lines, sewer lines, gas lines, electrical conduits, communication lines or conduits, direct buried electrical wires, and the like. Although the hole opener 10 is particularly suited for use with a horizontal directional drilling rig, in other embodiments, the hole opener 10 can be configured for use with other types of drilling rigs.

The illustrated hole opener 10 includes a shaft 14, tails 16, keys 18, blades 20, and a gauge ring 22. As will be discussed in more detail below, the hole opener 10 is configured so that the blades 20 can be replaced when the blades 20 are worn or when different types of blades 20 are desired based on the drilling application (e.g., type of earth material that is being drilled).

Figure 10:
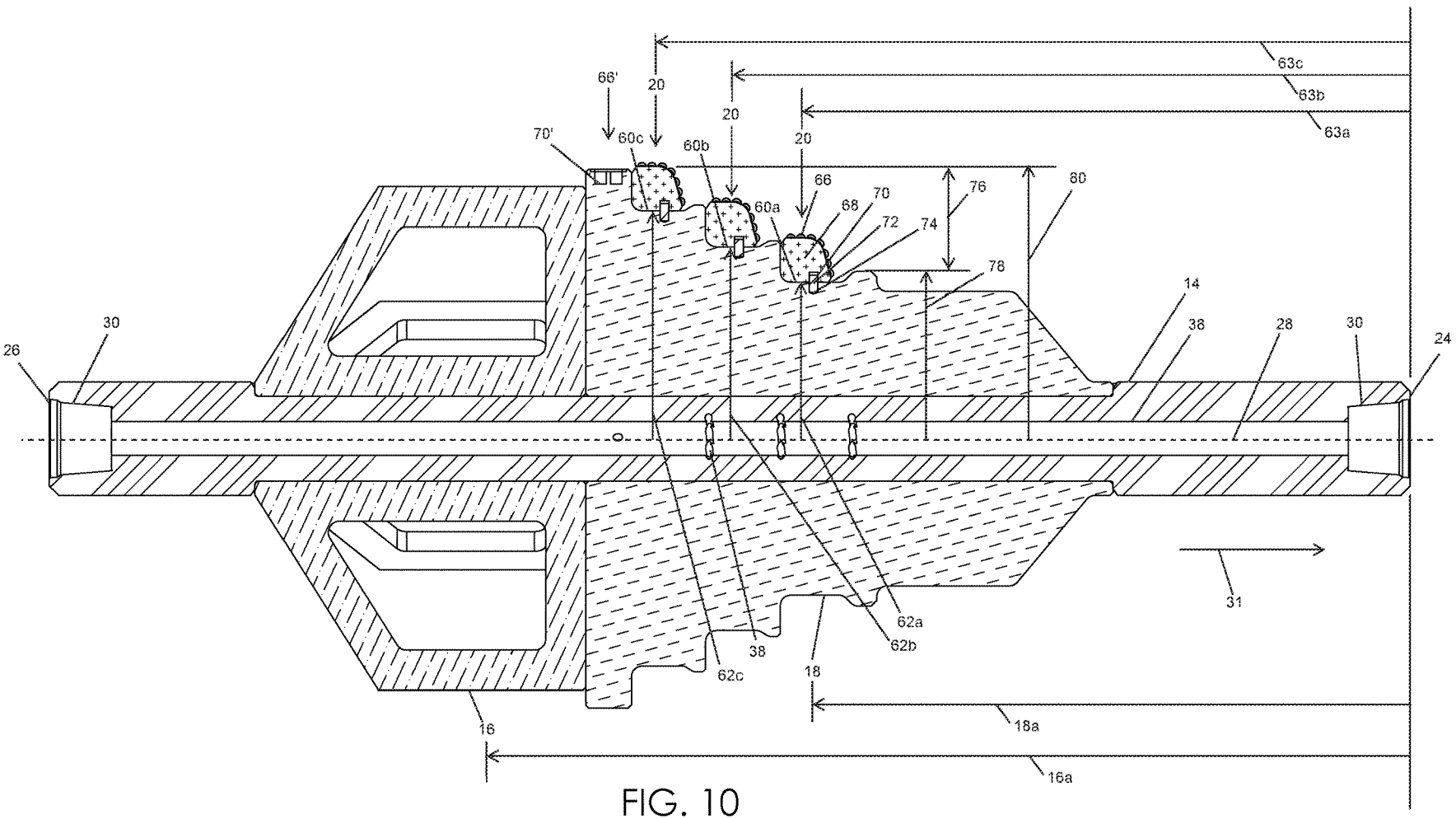
FIG. 10 is a cross-sectional view of the hole opener of FIG. 1 taken along line 10-10 of FIG. 8 illustrating the blades assembled on the key and showing multiple keys.

Referring to FIG. 10, the shaft 14 includes as first end 24, a second end 26, and a longitudinal axis 28 that extends centrally through the ends 24, 26. An aperture 30 is formed into each of the first end 24 and the second end 26. The apertures 30 are configured (e.g., threaded connection, pin connection, etc.) to mate with extension rods or drive rods 32 (FIG. 17) to connect the hole opener 10 to a drilling rig, such as the horizontal directional drilling rig 12. Rotation of the extension rods 32 by the drilling rig rotates the shaft 14 about axis 28, which rotates the blades 20 to perform the underground boring or drilling operation. In addition to rotating the hole opener 10 about the axis 28, the drilling rig 12 also moves or advances the hole opener 10 in the direction of arrow 31 of FIG. 10 to perform the drilling operation.

Figure 11:
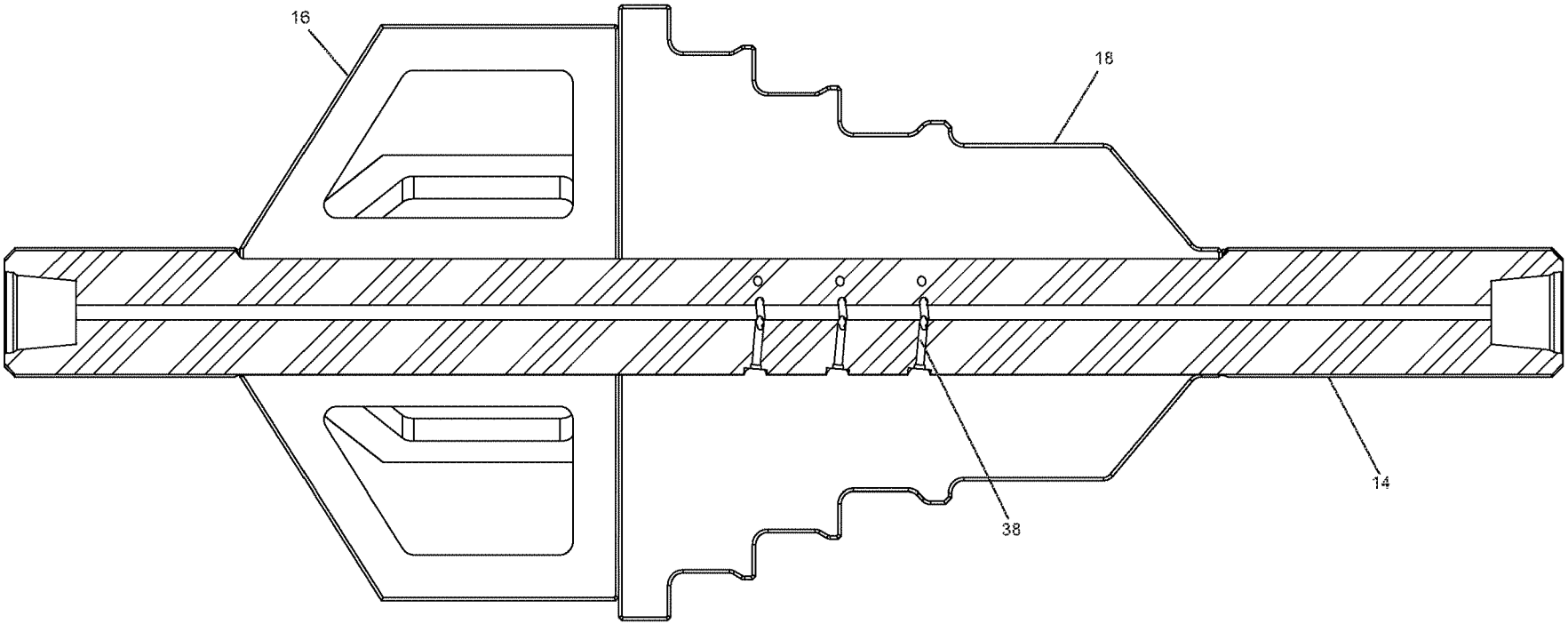
FIG. 11 is a cross-sectional view of FIG. 9 of the hole opener of FIG. 1 taken along line 11-11 of FIG. 8 illustrating fluid apertures extending from the shaft.

With reference to FIGS. 10 and 11, the illustrated shaft 14 includes a bore 36 that extends from the first end 24 to the second end 26 such that the shaft 14 is generally hollow. Fluid apertures 38 extend from the bore 36 to outside the shaft 14 between the tails 16 and the blades and the keys 18. The fluid apertures 38 allow a drilling fluid (e.g., bentonite clay) to pass through the rods 32 (FIG. 17), through the bore 36 and then through the fluid apertures 38 to remove cuttings from between the keys 18 and the tails 16. The drilling fluid also removes cuttings from the bore 36 and stabilizes the bore 36 to inhibit collapse of the bore 36.

Figure 2:
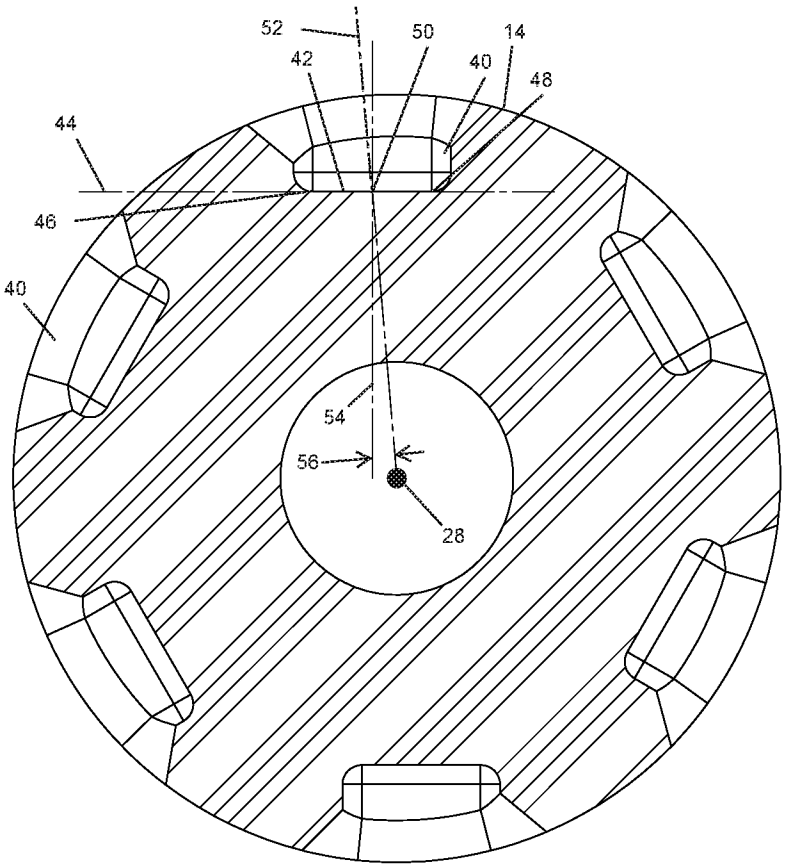
FIG. 2 is a cross-sectional view of a shaft of the hole opener of FIG. 1 taken along line 2-2 of FIG. 3.
Figure 3:
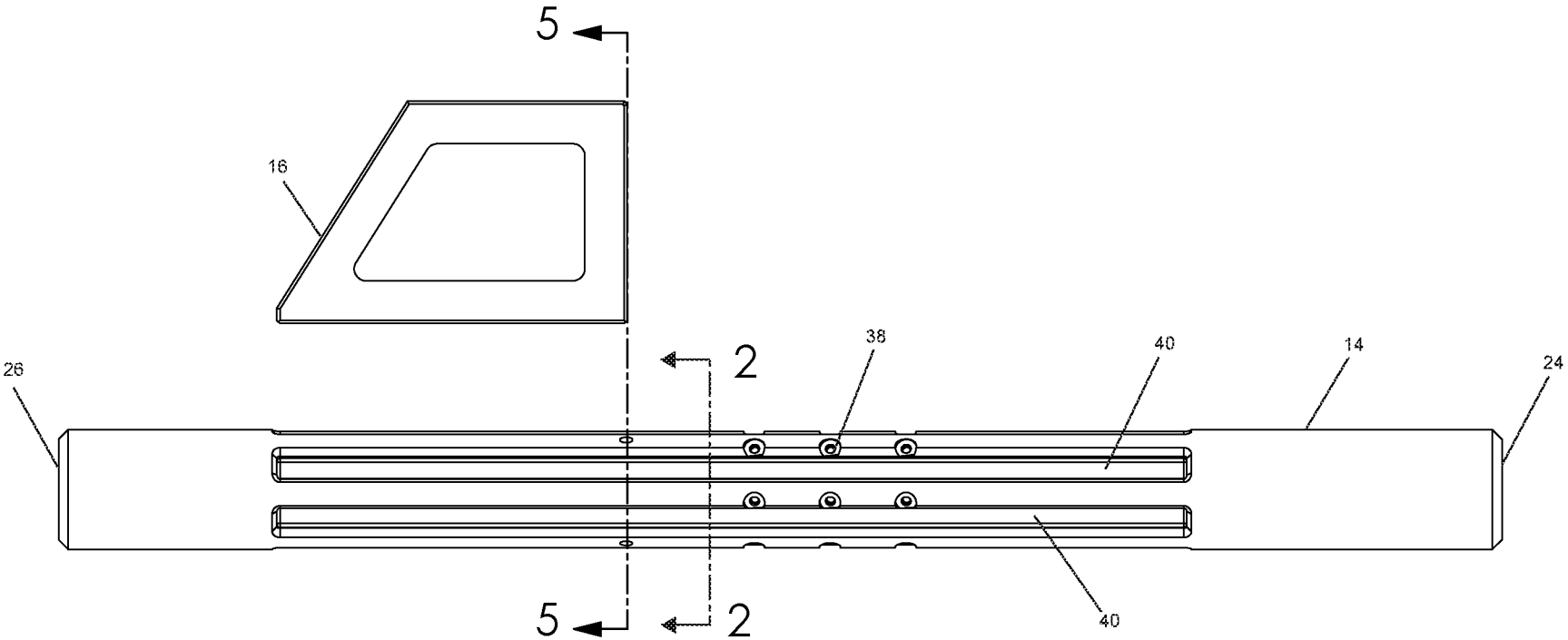
FIG. 3 illustrates a tail exploded from the shaft of the hole opener of FIG. 1.
Figure 4:
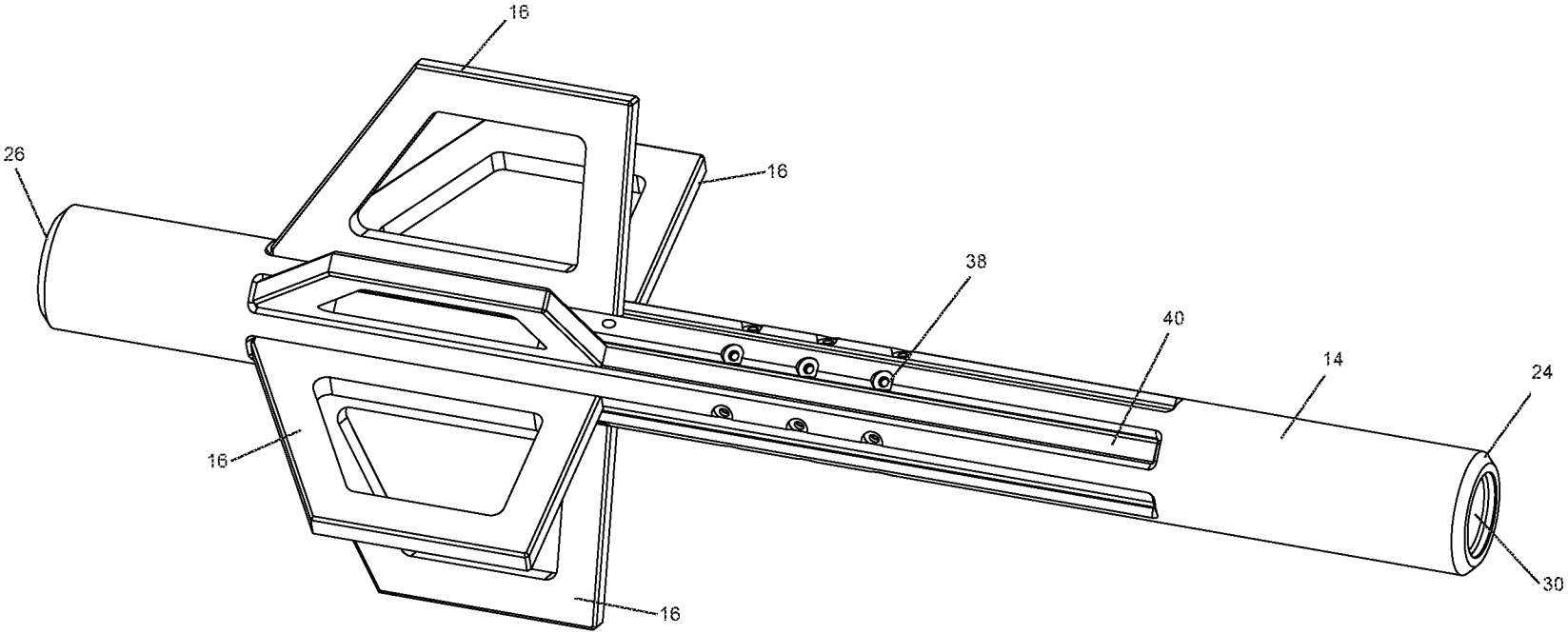
FIG. 4 is a perspective view of the tails assembled on the shaft of the hole opener of FIG. 1.

Referring to FIGS. 2 and 3, the shaft 14 further includes slots 40 that extend along and parallel to the longitudinal axis 28 of the shaft 14. The slots 40 receive the tails 16 and the keys 18 to locate or positions the tails 16 and keys 18 on the shaft 14. In one embodiment, the tails 16 and the keys 18 are welded to the shaft 14 after being positioned in the slots 40. The slots 40 provide additional stability and torque transfer capability from the shaft 14 to the tails 16 and to the keys 18 that support the blades 20. In the illustrated embodiment, the slots 40 are machined into the shaft 14. Also, in the illustrated embodiment, the shaft 14 includes six slots 40 evenly spaced around the circumference of the shaft 14. Therefore, the hole opener 10 includes six tails 16 and six keys 18. In other embodiments, the shaft 14 my include fewer than six slots 40 or more than six slots 40 and therefore, fewer than or more than six tails 16 and keys 18. As shown in FIG. 3, the fluid apertures 38 are between the slots 40 so that the tails 16 and keys 18 do not inhibit the drilling fluid from exiting the shaft 14.

Referring to FIG. 2, each slot 40 is off center or not symmetrical about the longitudinal axis 28 as explained below. The off center slot 40 better positions blades 20 for cutting and drilling the bore. The slot 40 includes a base or bottom surface 42. The bottom surface 42 is flat and the bottom surface 42 is within a plane 44 as shown in FIG. 2. The tail 16 and key 18 abut the bottom surface 42. Therefore, the orientation of the bottom surface 42 determines the orientation or direction the tails 16 and keys 18 extend from the shaft 14. The bottom surface 42 includes a first end 46 and a second end 48. The plane 44 also extends through the ends 46, 48. A center 50 of the slot 40 is located midway between ends 46, 48 along the plane 44. The slot 40 is off center in that a radially extending line 52 that extends from the longitudinal axis 28 through the center 50 is not perpendicular to the plane 44. Alternatively stated, a line 54 perpendicular to the plane 44 does not pass through the center of the shaft 14 or longitudinal axis 28. The line 54 is at an angle 56 relative to the radially line 52 through the center 50 of the slot 40. In one embodiment, the angle 56 is in a range from about 2 degrees to about 25 degrees. In another embodiment, the angle 56 is in a range from about 2 degrees to about 15 degrees and in a range from about 2 degrees to about 10 degrees in yet another embodiment. In yet other embodiments, the angle 56 is in a range from about 5 degrees to about 15 degrees.

Figure 5:
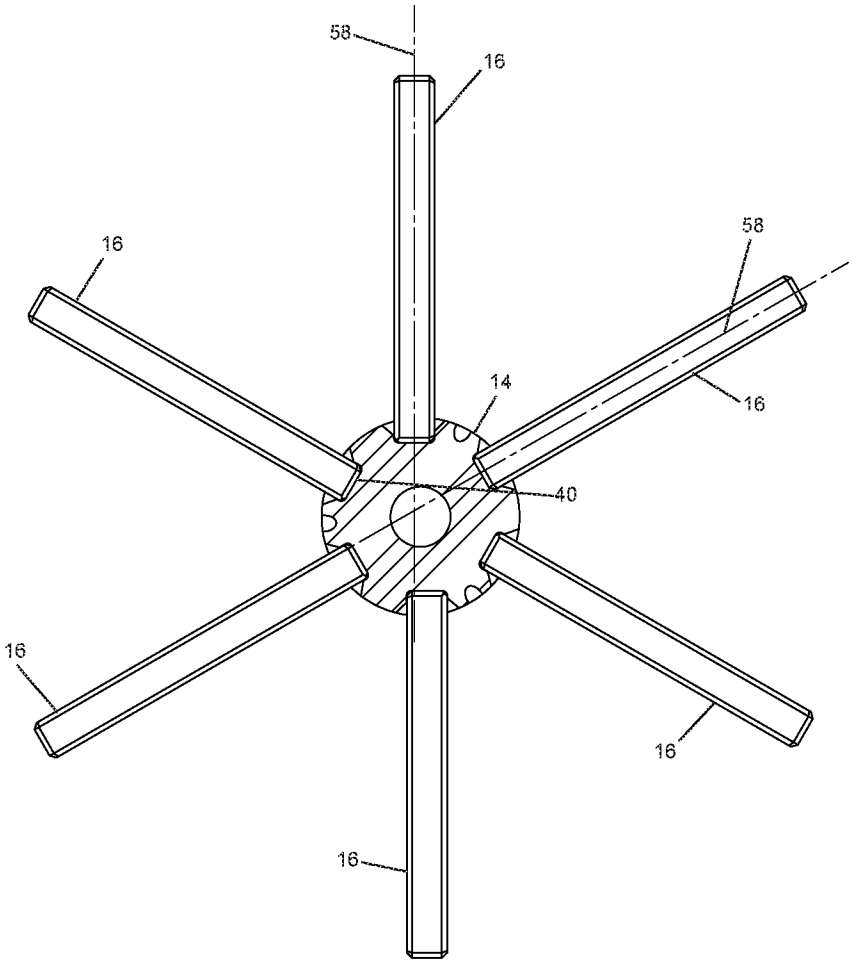
FIG. 5 is a cross-sectional view of the assembled tails and shaft of FIG. 4 taken along line 5-5 of FIG. 3.
Figure 6:
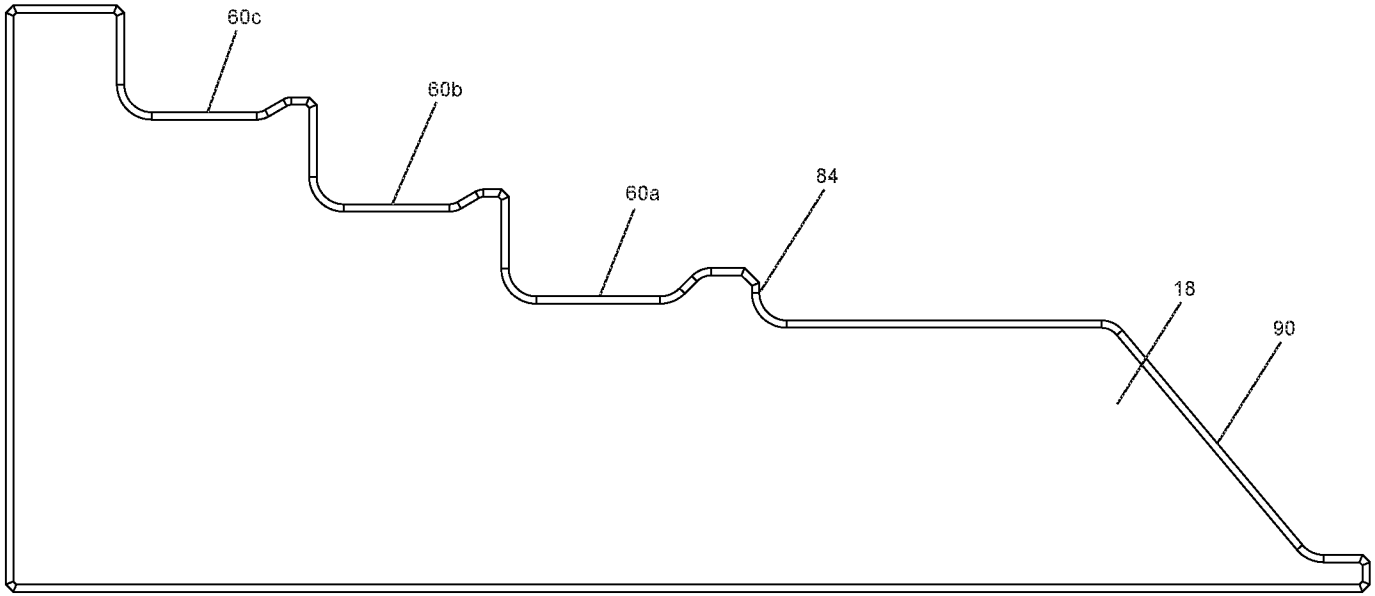
FIG. 6 is a side view of a key of the hole opener of FIG. 1.
Figure 7:
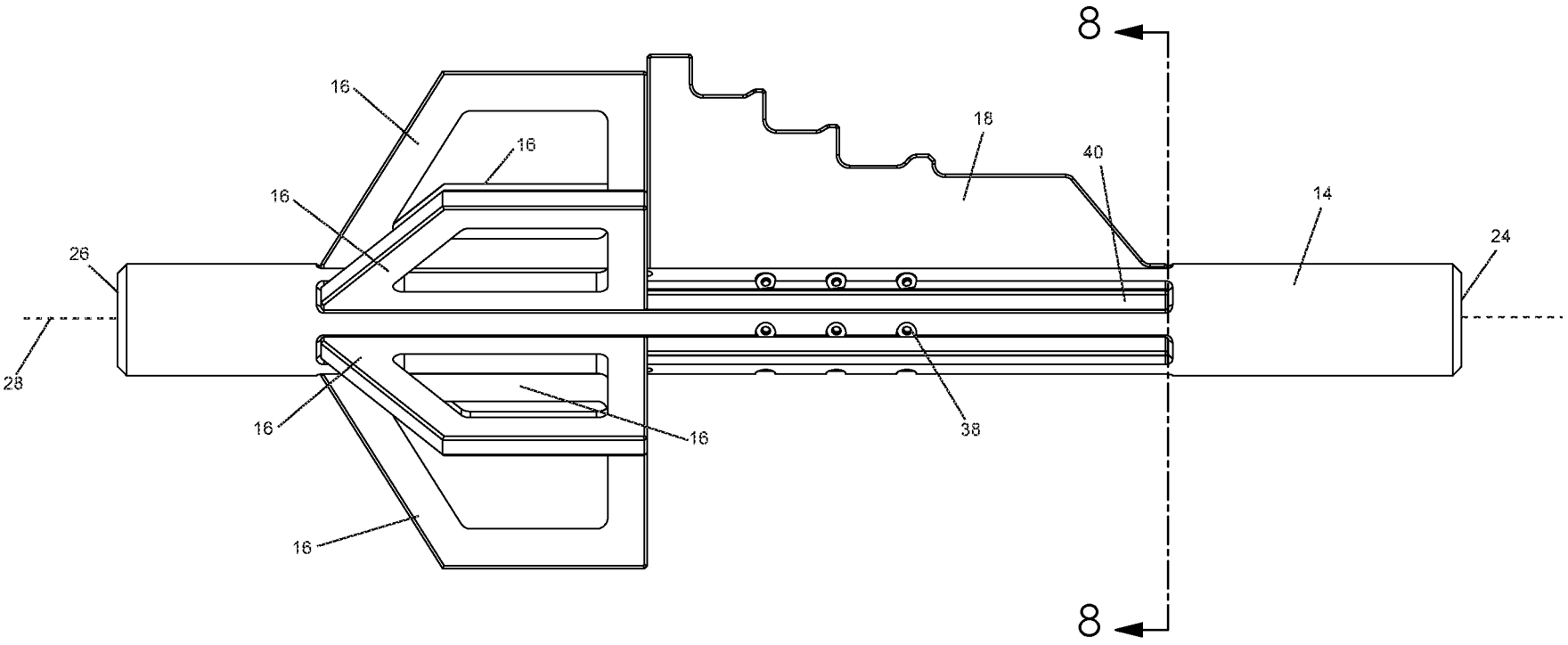
FIG. 7 illustrates the key of FIG. 6 assembled on the shaft of the hole opener of FIG. 1 with the tails.
Figure 8:
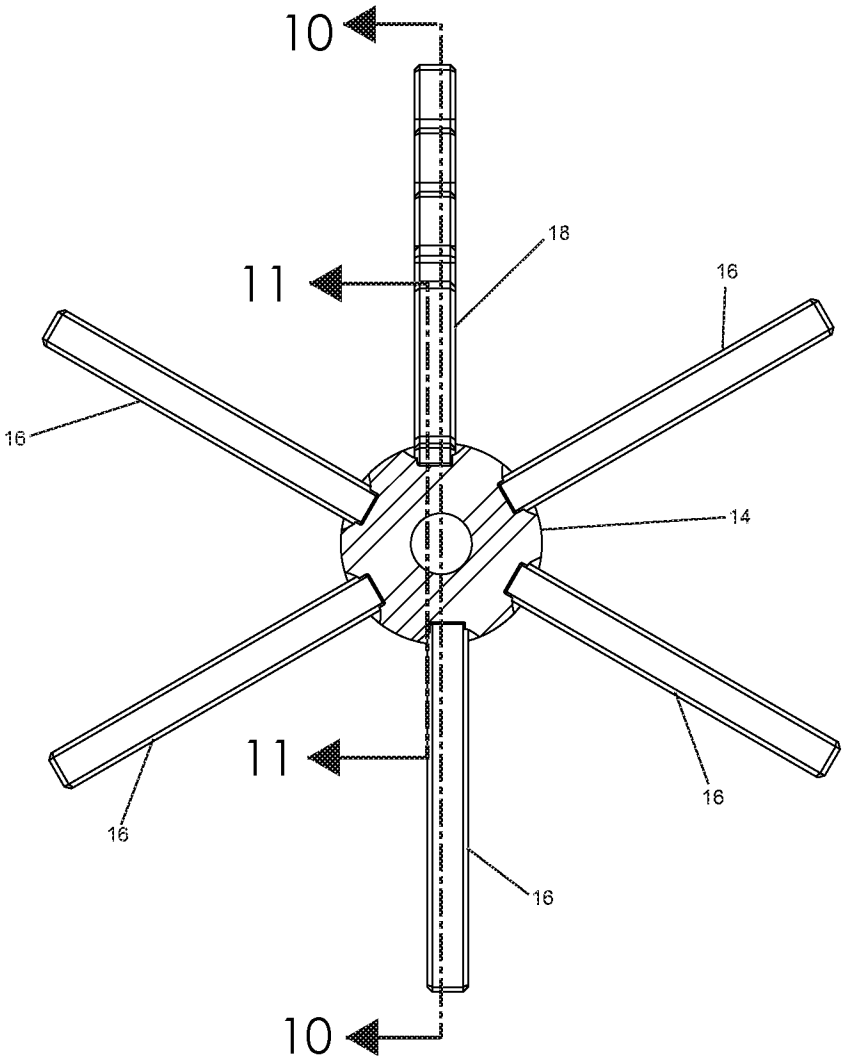
FIG. 8 is a cross-sectional view of FIG. 7 taken along line 8-8 of FIG. 7.

Referring to FIG. 10, a tail 16 and a key 18 are received in each of the slots 40. The key 18 is adjacent to and in front of the tail 16. In other words, a key distance 18*a* between the key 18 and the first end 24 is greater than a tail distance 16*a* between the tail 16 and the first end 24. Referring to FIG. 5, the off center configuration of the slots 40, discussed above, results in a central plane 58 of the tail 16 and key 18 that does not pass through the center of the shaft 14. Rather, the plane 58 is offset from the rotation axis 28 (FIG. 2) of the shaft 14.

Figure 9:
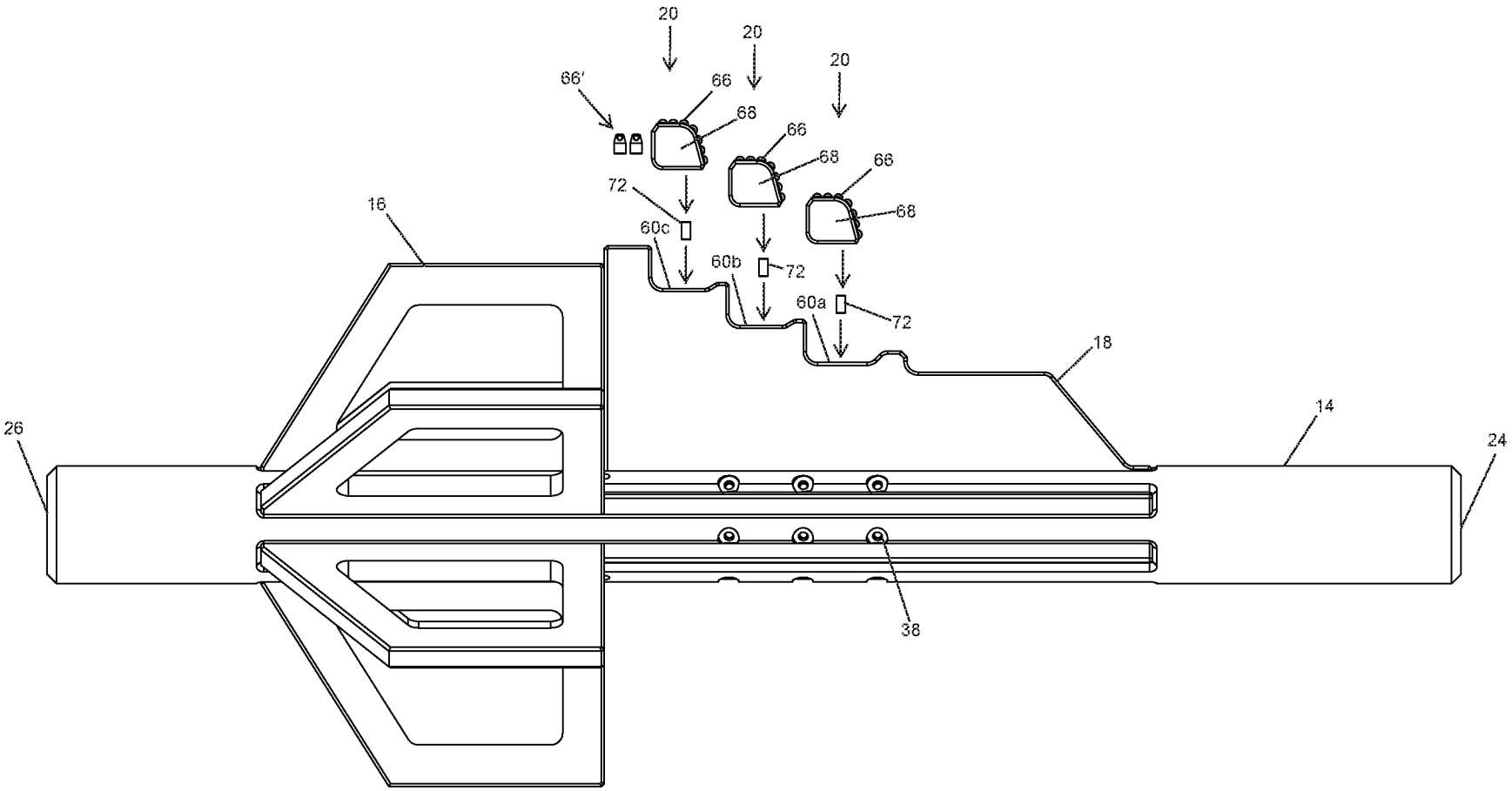
FIG. 9 illustrates blades of the hole opener of FIG. 1 exploded from the key.

Referring to FIGS. 9 and 10, the blades 20 are coupled to the keys 18. In the illustrated embodiment, each key 18 includes three blades 20. In other embodiments, the keys 18 may include fewer than three or more than three blades 20. The keys 18 includes recesses 60*a*, 60*b*, and 60*c* in a stepped configuration that each receive a blade 20. The first recess 60*a* is spaced a distance 62*a* from the longitudinal axis 28 as illustrated in FIG. 10 and also positioned a distance 63*a* from the end 24, which is the front end 24 when the hole opener 10 travels in the direction of arrow 31 of FIG. 10. The second recess 60*b* is spaced a distance 62*b* from the axis 28 that is greater than the distance 62*a* and the second recess 60*b* is between the first recess 60*a* and the third recess 60*c* along the axis 28. In other words, a distance 63*b* from the recess 60*b* to the first end 24 is between the distance 63*a* and a distance 63*c* between the first end 24 and the recess 60*a*. The third recesses 60*c* is spaced a distance 62*c* from the axis 28 that is greater than the distance 62*b* and the third recesses 60*c* is closer to the back end 26 of the shaft 14 than the other recesses 62*a* and 62*b*. In other words, the distance 63*c* is greater than both the distance 63*a* and the distance 63*b*.

Referring to FIG. 10, the recesses 60*a*-60*c* are in the stepped configuration as described above to properly position the blades 20 received in the recesses 60*a*-60*c* for drilling. That is, the blades 20 are exposed continually along a radial distance 76 from the axis 28. Therefore, as the hole opener 10 rotates about the axis 28 and moves in the direction of arrow 31 the hole opener enlarges the bore to a radius 80. The hole opener 10 is configured to enlarge or open a bore having approximately a minimum starting radius 78 and enlarge the bore to a radius 80.

The blades 20 include cutters 66 fixed to a base 68. The cutters 66 can include any suitable cutter including, polycrystalline diamond compact cutters, tungsten carbide cutters, diamond impregnated tungsten carbine cutters, cubic boron nitride cutters, and the like. In one embodiment, the base 68 is steel or a similar material to the key 18. The blades 20 further include a pin bore 70 and a pin 72 that is received in the pin bore 70. The pin 72 is received in a corresponding bore 74 (i.e., a key bore 74) of the key 18 to couple the blades 20 to the key 18. The pin 72 and bores 70, 72 allow a user to quickly and easily properly position the blades 20 when the blades 20 are replaced. In one embodiment, the base 68 is also welded to the key 18. The blades 20 are removably coupled to the key 18 by the pin and welding arrangement described above so that the blades 20 can be removed and replaced. The user may remove or replace the blades 20 when the cutters 66 are worn or replaced when a different cutter type is desired depending on the drilling operation. For example, if the drilling operation is in a hard earth material, the blades 20 (i.e., a first blade and a second blade) may be replaced with a cutter 66 suited for hard earth material (i.e., a third blade and a fourth blade). If the next drilling operation is in a soft earth material, the blades 20 are replaced with a cutter 66 suited for soft earth material. Therefore, the user can relatively easily replace the blades 20 by removing the weld, removing the blades 20, and replacing the blades 20 with different blades and welding the new blades 20 to the key 18.

With continued reference to FIG. 10, cutters 66' engage bores 70' of the key 18. The bores 70' extend radially inwardly from an edge of the key 18 towards the longitudinal axis 28 of the shaft 14. When the cutters 66' engage the bores 70', the cutters 66' extend radially outwardly from within the bores 70' to the radius defining the enlarged size of the bore created by the hole opener 10. FIG. 1 illustrates the cutters 66' extending from the bores 70'. Longitudinally (i.e., in a direction of the longitudinal axis 28 of the shaft 14), the blades 20 are closer to the first end 24 of the shaft 14 when compared to the cutters 66' and the bores 70'.

Figure 12:
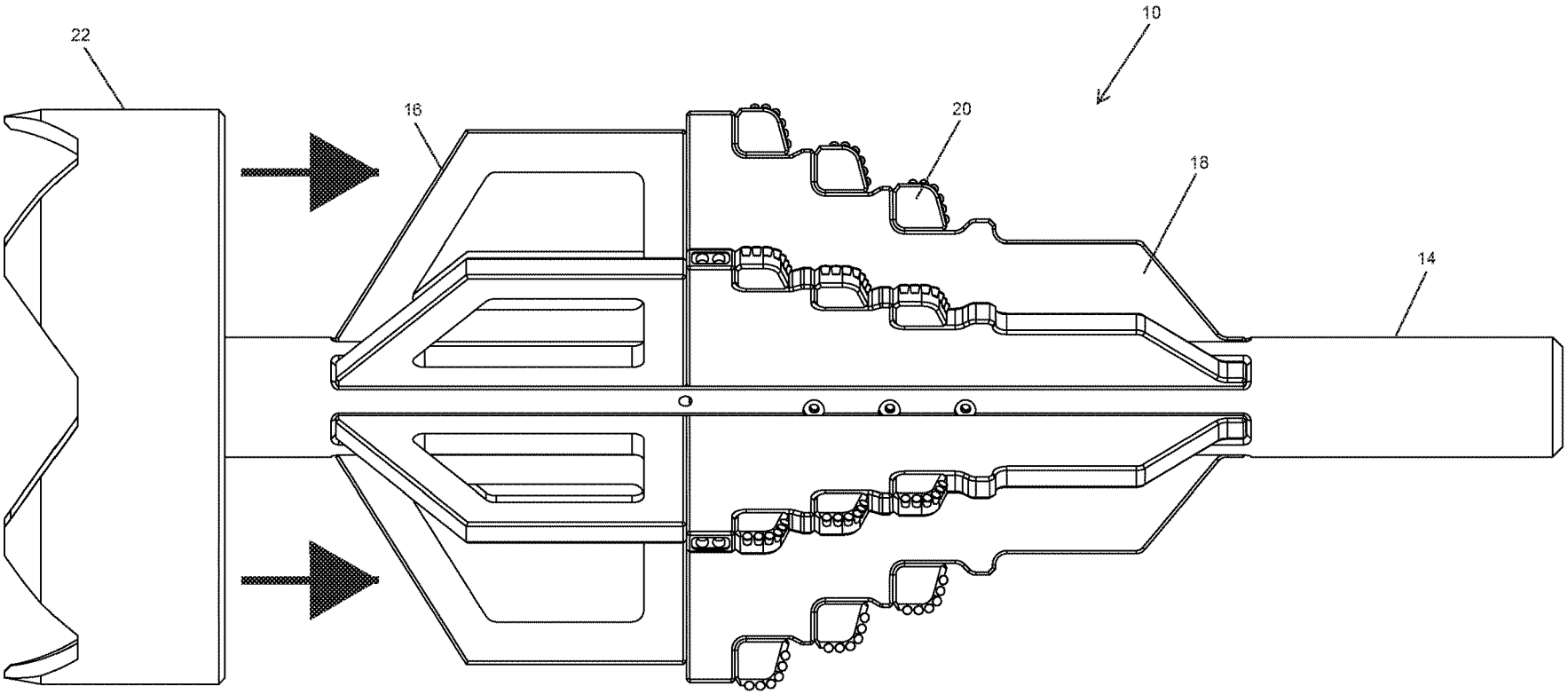
FIG. 12 illustrates a gauge ring of the hole opener of FIG. 1 exploded from the hole opener.
Figure 15:
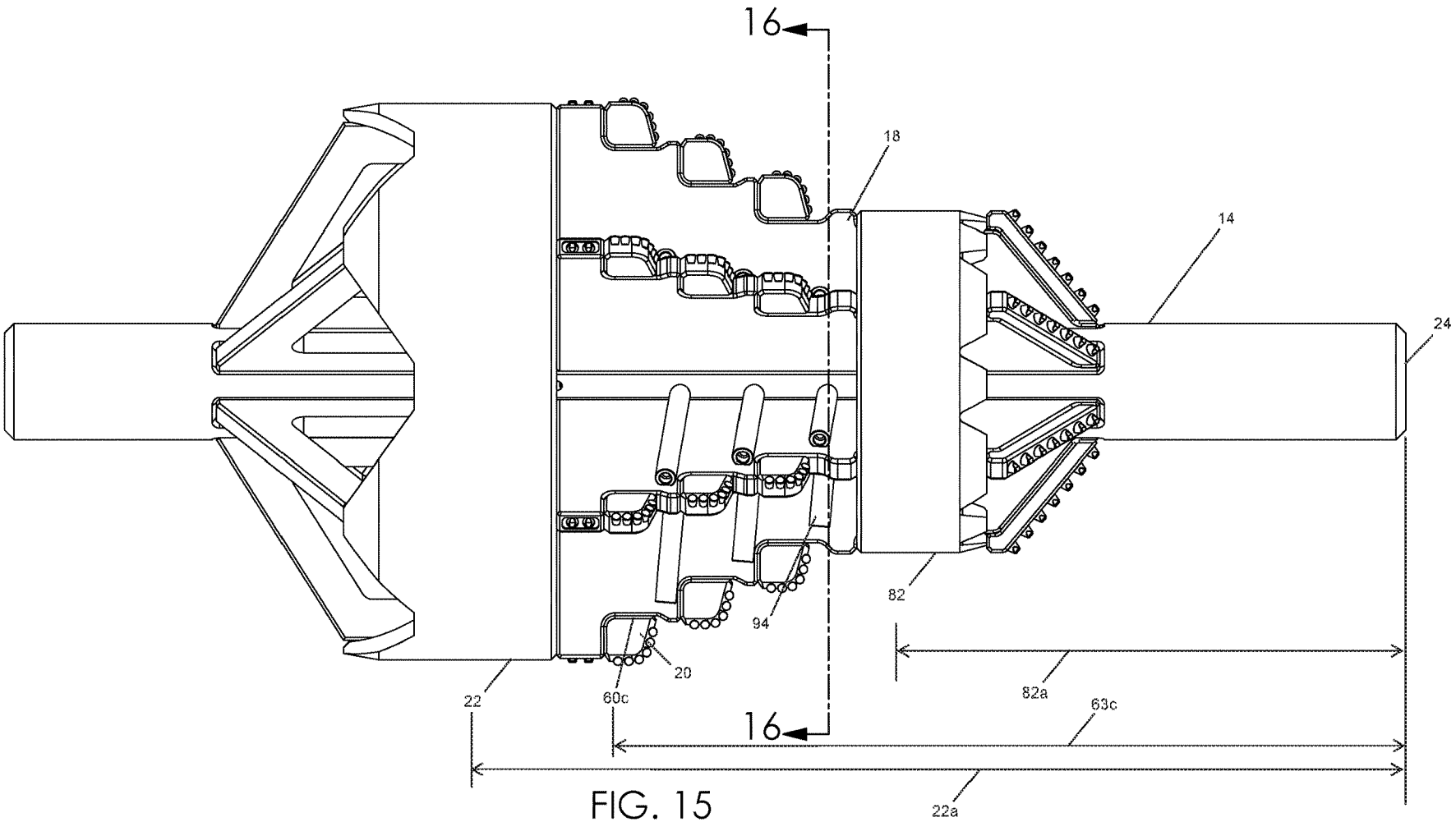
FIG. 15 is a side view of the hole opener of FIG. 1.

With reference to FIG. 12, the gauge ring 22 coupled to the hole opener 10 over the tails 16 from a position adjacent the second end 26 of the shaft 14 to a position radially outward of the tails 16 relative to the shaft 14. The gauge ring 22 abuts an edge of the keys 18 closest to the recess 60*c*. With reference to FIG. 15, the gauge ring 22 is positioned longitudinally (in a direction of the longitudinal axis 28) behind the key 18 and radially outward of the tail 16. In other words, a gauge ring distance 22*a* between the gauge ring 22 and the first end 24 of the shaft 14 is greater than a longitudinal distance 63*c* between a blade 20 mounted in the recess 60*c* and the first end 24. An outer surface of the gauge ring 22 is spaced from the longitudinal axis 28 of the shaft 14 an amount of the radius 80 which defines the enlarged size of the bore created by the hole opener 10. The gauge ring 22 applies pressure radially outwardly from the longitudinal axis 28 of the shaft 14 to the edges of the bore created by the hole opener 10. The gauge ring 22 ensures that the radius 80 cut by the blades 20 is retained after the hole opener 10 is no longer in contact with the bore.

Figure 13:
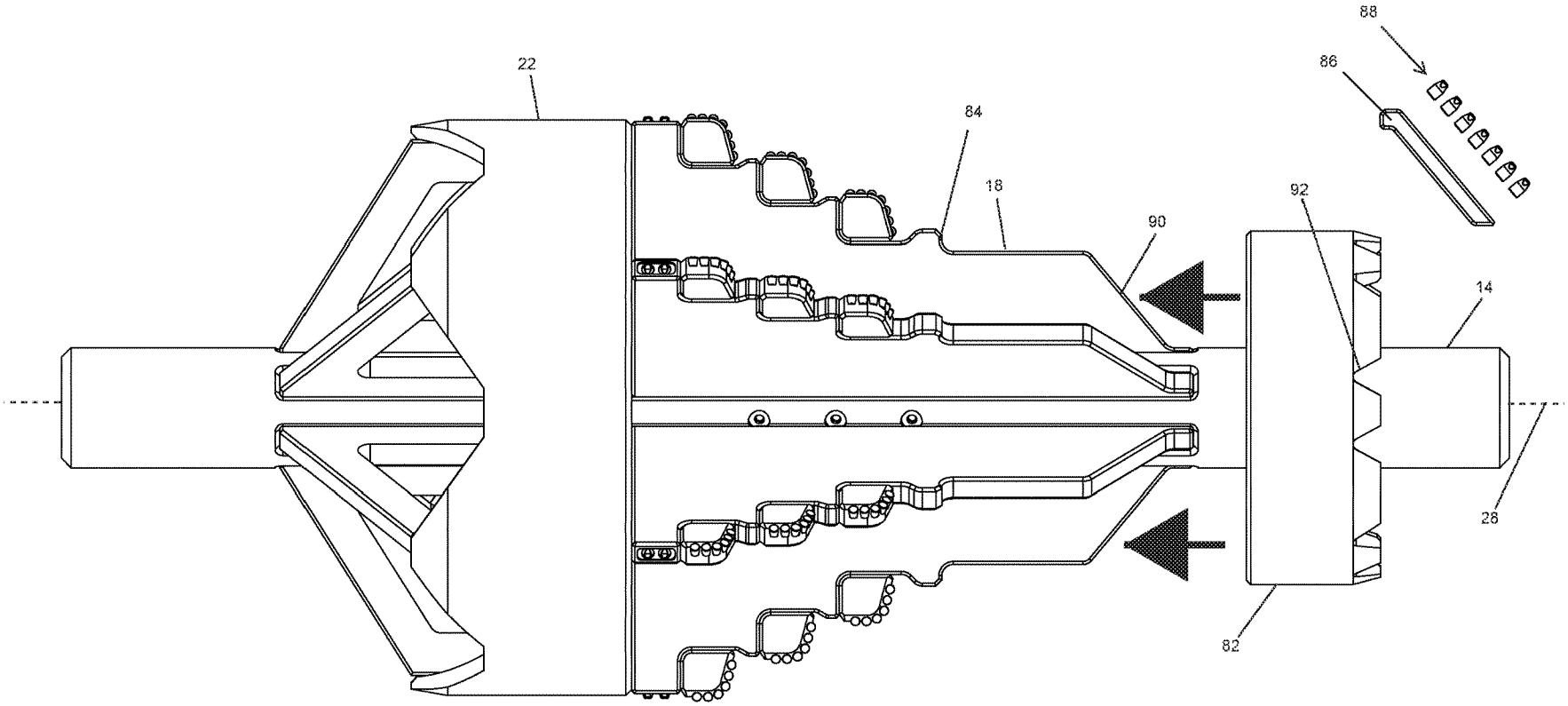
FIG. 13 illustrates a guide ring of the hole opener of FIG. 1 exploded from the hole opener.

With reference to FIG. 13, a guide ring 82 is coupled to the hole opener 10 over the keys 18 from a position adjacent the first end 24 of the shaft 14 to a position radially outward of the keys 18 relative to the shaft 14. In other words, the guide ring 82 is positioned longitudinally (in a direction of the longitudinal axis 28) in front of the blades 20 and radially outward of the keys 18. With reference to FIGS. 10 and 15, the guide ring 82 is positioned a guide ring distance 82*a* away from the first end 24. The guide ring distance is less than the key distance 18*a*. The guide ring 82 abuts a guide ring projection 84 of the keys 18.

A wear bar 86 including a plurality of cutters 88 is coupled to an angled portion 90 of the key 18. During operation, cutters 88 mounted on the wear bar 86 engage a hole or bore in the ground and center the hole opener 10 on the hole or bore in the ground. In one embodiment, the wear bar 86 is steel and is welded onto the key 18 and the cutters 88 are tungsten carbide and are brazed onto the wear bar 86. The wear bar 86 is replaceable from the angled portion 90 through welding and the cutters 88 are individually replaceable from the wear bar 86 through brazing. Other attachment methods between the cutters 88 and the wear bar 86 and the wear bar 86 and the keys 18 may be used. Other materials of the cutters 88 are possible, such as those listed above for the cutters 66. The guide ring 82 includes cutouts 92 permitting cuttings from the cutters 88 to be passed radially outwardly relative to the longitudinal axis 28 from within the minimum starting radius 78. The cuttings are removed from between the key 18 and a second key 18 mounted on the shaft 14. The cutouts 92 are triangularly shaped in the illustrated embodiment.

Figure 14:
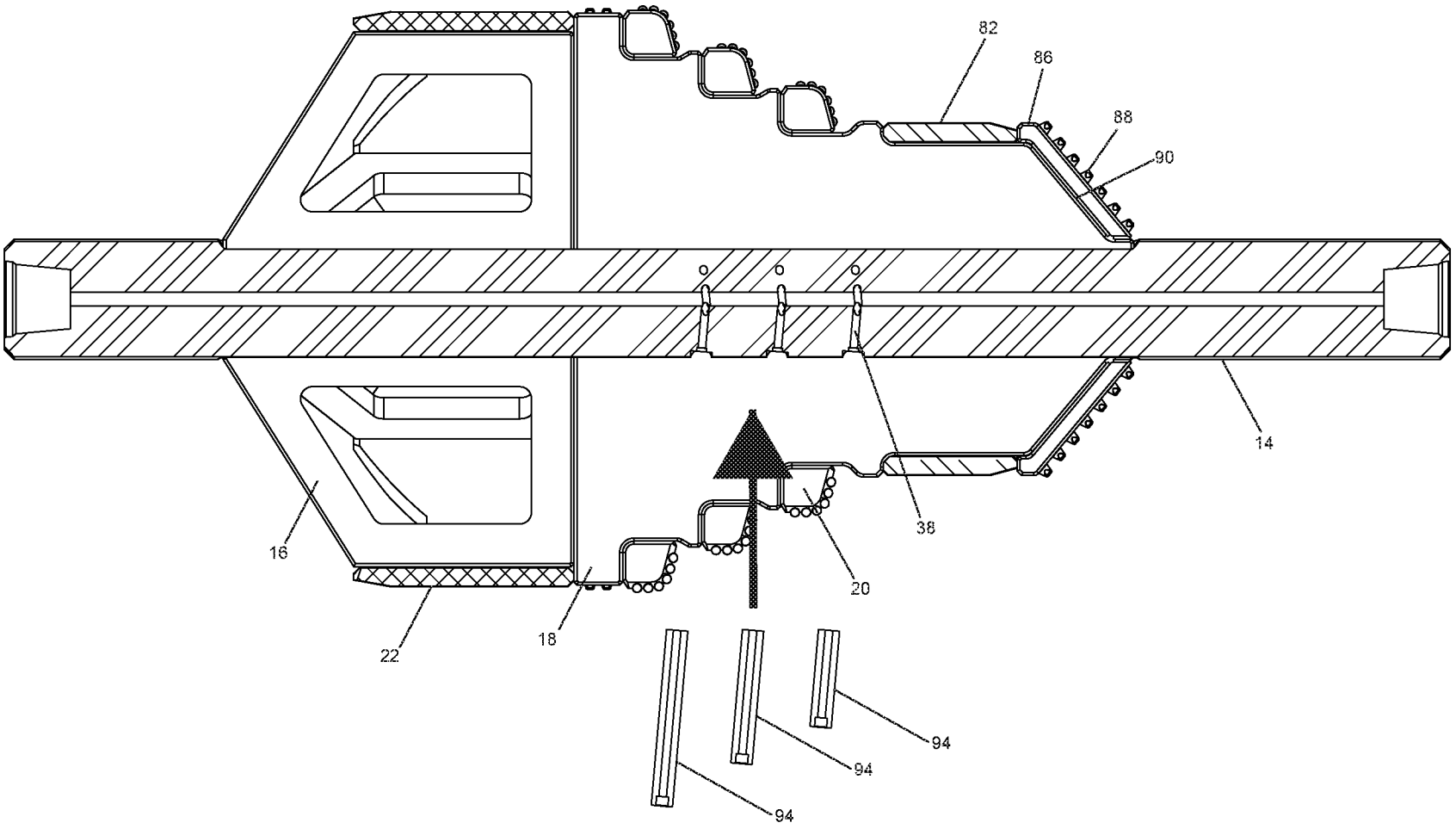
FIG. 14 is a cross-sectional view of FIG. 1 illustrating flow tubes of the hole opener of FIG. 1 exploded from the hole opener.
Figure 16:
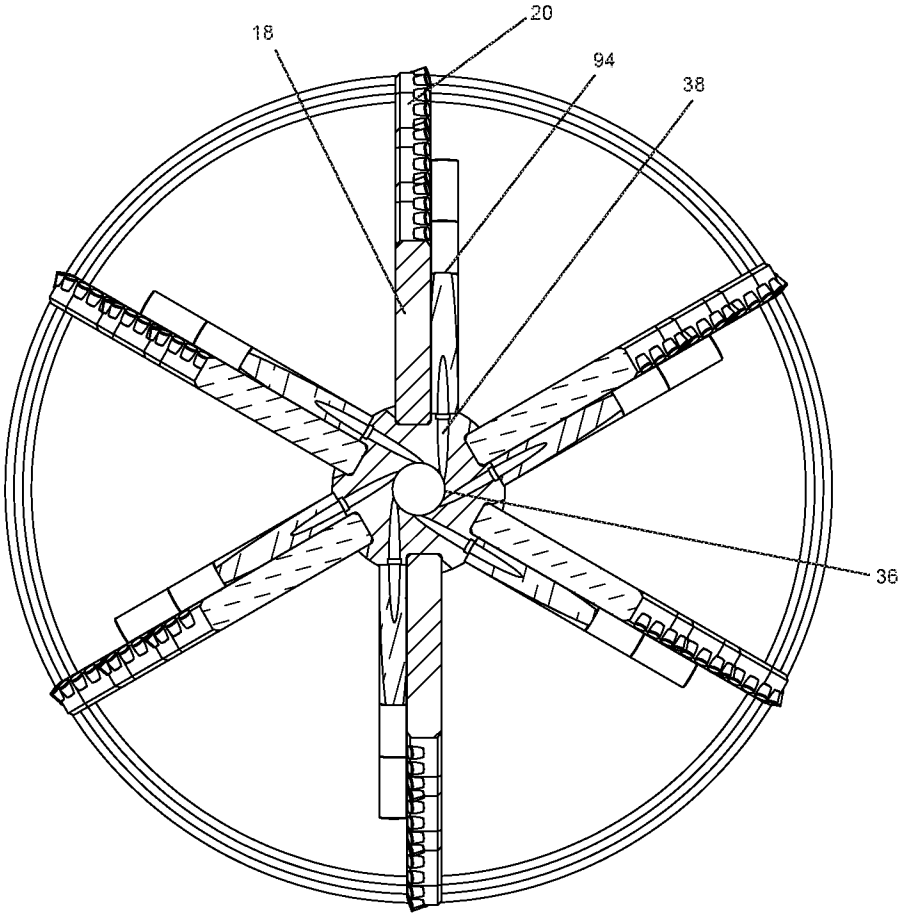
FIG. 16 is a cross-sectional view of FIG. 15 taken along line 16-16 of FIG. 15.

With reference to FIGS. 14-16, flow tubes 94 are coupled to the shaft 14 and the key 18 to adjust an exit location of the fluid from the fluid apertures 38. The flow tubes 94 define cylindrical passageways that permit the flow of fluid there through. The flow tubes 94 extend radially outwardly from the shaft 14 and are positioned rotationally ahead of an adjacent key 18. The flow tubes 94 reposition the exit location of the fluid apertures 38 from adjacent the shaft 14 (without the flow tubes 94) to a position adjacent each blade 20. Fluid is more efficiently applied to the cutters 66 when the flow tubes 94 are attached.

Figure 17:
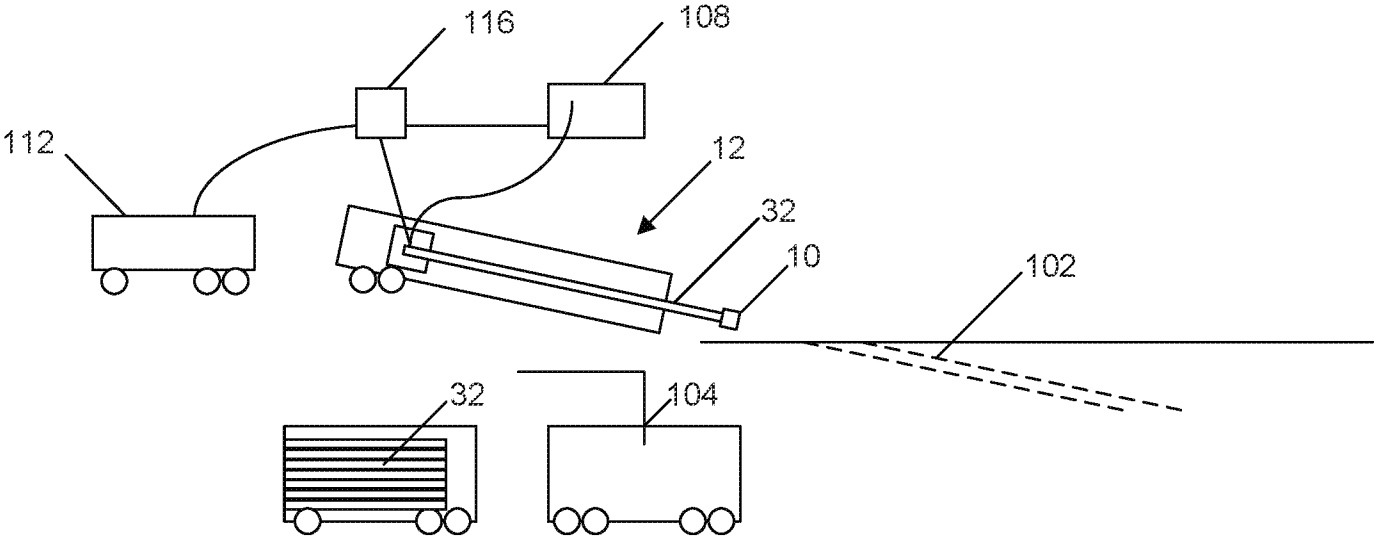
FIG. 17 illustrates a horizontal drilling rig configured for use with the hole opener of FIG. 1.

Referring to FIG. 17, and in a cutting operation of the hole opener 10, extension rods 32 are moved by the crane 104 onto the drill rig 12. The extension rods 32 are translated through a hole 102 to be reamed to the opposite end (not shown) of the hole 102, with additional extension rods 32 being added as the extension rods 32 are translated through the hole 102. The extension rods 32 are attached to the hole opener 10. An operator in the control trailer 108 supplies power through the power unit 116 to the drill rig 12 to rotate the hole opener 10, and translate the hole opener 10 along a cutting path of the hole 102. In some embodiments, the cutting path of the hole 102 is directed towards the drill rig 12, and the hole opener 10 is pulled through the hole 102. In this embodiment, the crane 104 lifts extension rods 32 from the drill rig 12 as they are translated out of the hole 102. Alternatively, the cutting path of the hole 102 can be directed away from the drill rig 12, and the hole opener 10 is pushed through the hole 102 by the drill rig 12. In this alternative embodiment, the crane 104 lifts extension rods 32 to apply them to the drill rig 12 as they are needed to further translate the hole opener 10 through the hole 102. During drilling, cuttings from within the hole 102 created by the hole opener 10 are excavated into the mud rig 112 for removal from the reamed hole 102.

Figure 18:
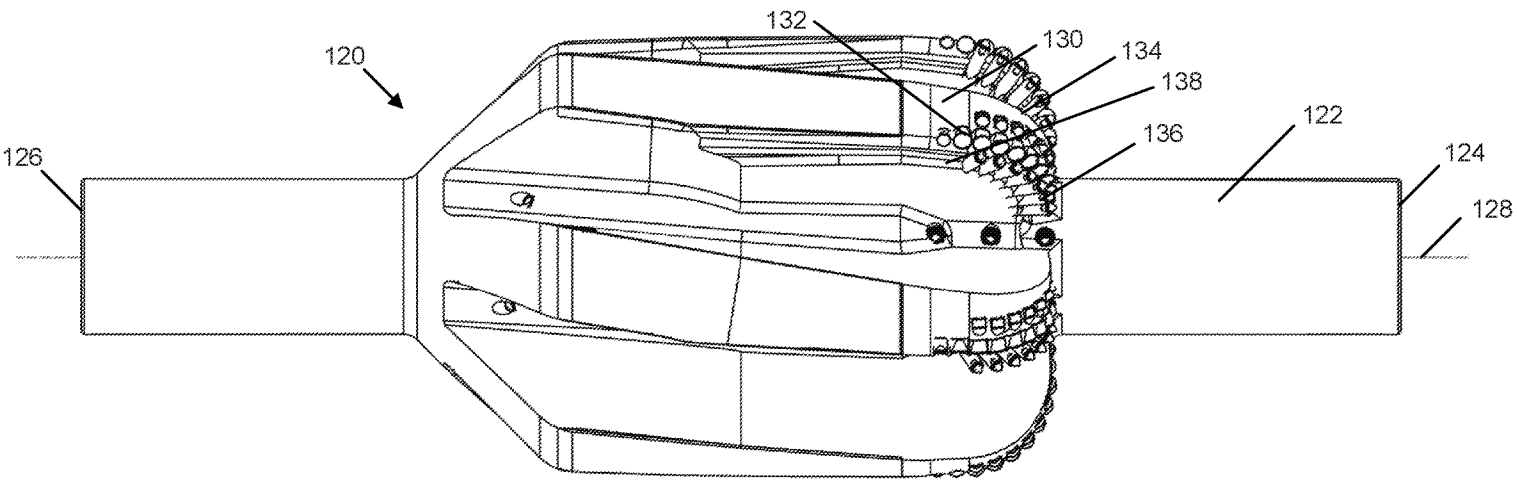
FIG. 18 illustrates side view of a hole opener according to another embodiment.
Figure 19:
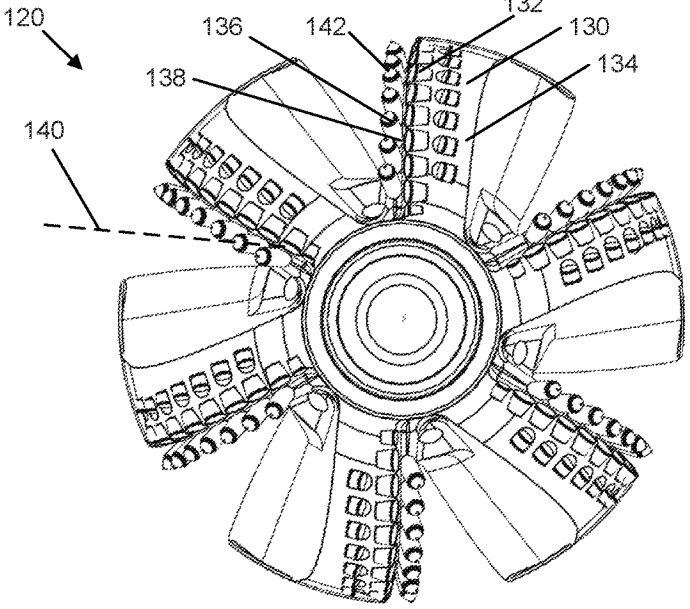
FIG. 19 illustrates a top view of the hole opener of FIG. 18.

Referring to FIGS. 18 and 19, an alternate hole opener 120 includes a shaft 122 having a first end 124 and a second end 126. A longitudinal axis 128 of the shaft 122 extends through the ends 124, 126. A blade 130 extends radially outwardly from the shaft 122. Shearing cutters 132 are mounted on a top surface 134 of the blade 130. Gouging cutters 136 are mounted to a side surface 138 of the blade 130. Each gouging cutter 136 defines a gouging cutter axis 140 extending from a tip 142 of the gouging cutter 136 towards the side surface 138 where the gouging cutter 136 is mounted to the blade 130. During a cutting operation of the hole opener 120, the shaft 122 is rotated counterclockwise about the longitudinal axis 128 when viewed from FIG. 19. As such, gouging cutters 136 mounted on a blade 130 contact the material being cut prior to the shearing cutters 132 mounted on the same blade 130. The gouging cutter 136 is fixedly mounted to the blade 130 to inhibit rotation of the gouging cutter 136 about the gouging cutter axis 140 during a cutting operation. Optionally, the gouging cutters 136 and the shearing cutters 132 may be removably coupled to the blade 130 for replacement of worn cutters 132, 136. The gouging cutters 136 and shearing cutters 132 may consist of the same materials listed above for the cutters 66.

What is claimed is:

1. A hole opener configured for use with a horizontal directional drilling rig, the hole opener comprising:

a shaft including a front end, a rear end, and a longitudinal axis that extends through the front end and the rear end, the shaft configured for rotation about the longitudinal axis by the horizontal directional drilling rig, and the shaft further comprising a plurality of slots extending parallel to the longitudinal axis, each of the plurality of slots being radially evenly spaced around a circumference of the shaft;

a plurality of keys coupled to the shaft for rotation with the shaft, each of the plurality of keys being received in a respective one of the plurality of slots, each of the plurality of keys being removably coupled to the shaft within the respective one of the plurality of slots of the shaft;

a first blade removably coupled to one of the plurality of keys, the first blade spaced a first radial distance from the longitudinal axis and spaced a first longitudinal distance from the front end; and a second blade removably coupled to the one of the plurality of keys, the second blade spaced a second radial distance from the longitudinal axis that is greater than the first radial distance, and the second blade spaced a second longitudinal distance from the front end that is greater than the first longitudinal distance, wherein the at least one of the plurality of slots defines a flat surface having a front end, a rear end, and a center located midway between the front end and the rear end, a line extending through the center and perpendicular to the flat surface does not pass through the longitudinal axis of the shaft.

2. The hole opener of claim 1, wherein the first blade includes a base and a cutter where the cutter is fixed to the base and the base is removably coupled to the one of the plurality of keys.

3. The hole opener of claim 1, wherein the first blade further comprises a pin bore and the one of the plurality of keys further comprises a key bore, the hole opener further comprising a pin, wherein the pin is received in the pin bore and the key bore to couple the first blade to the one of the plurality of keys.

4. The hole opener of claim 3, wherein the first blade and the second blade are removably coupled to the one of the plurality of keys.

5. The hole opener of claim 1, further comprising a third blade removably coupled to the one of the plurality of the keys when the first blade is removed from the one of the plurality of keys, the third blade spaced the first radial distance from the longitudinal axis and spaced the first longitudinal distance from the front end, wherein the first blade includes cutters of a first cutter type and the third blade includes cutters of a second cutter type different than the first cutter type.

6. The hole opener of claim 1, wherein a radially extending line passing through the center and the longitudinal axis of the shaft is angled relative to the line perpendicular to the flat surface at an angle in a range from 2 degrees to 25 degrees.

7. The hole opener of claim 6, wherein the angle is in a range between 5 and 15 degrees.

8. The hole opener of claim 1, further comprising a tail removably coupled within one of the plurality of slots of the shaft adjacent one of the plurality of keys, wherein the one of the plurality of keys is closer to the front end than the tail.

9. The hole opener of claim 1, wherein the plurality of keys comprises a first key and a second key each coupled to the shaft for rotation with the shaft; the first blade being removably coupled to either the first key or the second key; the shaft includes a bore extending from the front end of the shaft to a rear end of the shaft such that the shaft is generally hollow, the hole opener further comprising fluid apertures configured to permit a drilling fluid to pass through the bore and the fluid apertures to remove cuttings from between the first key and the second key.

10. The hole opener of claim 1, further comprising a cutter, and wherein the one of the plurality of keys further comprises a bore extending from an edge of the one of the plurality of keys towards the longitudinal axis of the shaft, wherein the cutter is removably coupled to the shaft in the bore.

11. The hole opener of claim 10, wherein the first blade and the second blade are closer to the front end of the shaft than the bore.

12. A hole opener configured for use with a horizontal directional drilling rig, the hole opener comprising:

a shaft including a front end, a rear end, and a longitudinal axis that extends through the front end and the rear end, the shaft configured for rotation about the longitudinal axis by the horizontal directional drilling rig, and the shaft further comprising a plurality of slots extending parallel to the longitudinal axis;

a plurality of keys coupled to the shaft for rotation with the shaft, each of the plurality of keys being received in a respective one of the plurality of slots, each of the plurality of slots being radially evenly spaced about the shaft;

a first blade removably coupled to one of the plurality of keys, the first blade spaced a first radial distance from the longitudinal axis and spaced a first longitudinal distance from the front end;

a second blade removably coupled to the one of the plurality of keys, the second blade spaced a second radial distance from the longitudinal axis that is greater than the first radial distance, and the second blade spaced a second longitudinal distance from the front end that is greater than the first longitudinal distance;

a tail removably coupled within the one of the plurality of slots of the shaft adjacent the one of the plurality of keys, the one of the plurality of keys being closer to the front end than the tail; and a gauge ring removably coupled to the tail and multiple tails each removably coupled within one of the plurality of slots of the shaft, the gauge ring circumscribing the longitudinal axis and coupling the tails to each other.

13. The hole opener of claim 12, wherein the second blade is closer to the front end than the gauge ring.

14. The hole opener of claim 12, further comprising a guide ring removably coupled to at least two of the plurality of keys, each of the plurality of keys being removably coupled within a correspond one of the plurality of slots of the shaft, the guide ring circumscribing the longitudinal axis and coupling the at least two keys to each other.

15. The hole opener of claim 14, wherein the guide ring is closer to the front end than the first blade.

16. A hole opener for use with a horizontal directional drilling rig, the hole opener comprising:

a shaft including a front end, a rear end, and a longitudinal axis that extends through the front end and the rear end, the shaft configured for rotation about the longitudinal axis by the horizontal directional drilling rig, and the shaft further comprising a plurality of slots extending parallel to the longitudinal axis;

a plurality of keys coupled to the shaft for rotation with the shaft, each of the plurality of keys being received in a respective one of the plurality of slots;

a first blade removably coupled to one of the plurality of keys, the first blade spaced a first radial distance from the longitudinal axis and spaced a first longitudinal distance from the front end;

a second blade removably coupled to the one of the plurality of keys, the second blade spaced a second radial distance from the longitudinal axis that is greater than the first radial distance, and the second blade spaced a second longitudinal distance from the front end that is greater than the first longitudinal distance; and a wear bar removably coupled to the one of the plurality of keys, the wear bar being closer to the front end and closer to the longitudinal axis when compared to the first blade.

17. The hole opener of claim 16, wherein the wear bar further comprises cutters removably coupled to the wear bar.

* * * * *